US009279574B2

(12) United States Patent
Preuschl et al.

(10) Patent No.: US 9,279,574 B2
(45) Date of Patent: Mar. 8, 2016

(54) LIGHTING MODULE

(71) Applicant: OSRAM GmbH, Munich (DE)

(72) Inventors: Thomas Preuschl, Sinzing (DE); Dieter Eisenhut, Burglengenfeld (DE)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 14/376,892

(22) PCT Filed: Feb. 14, 2013

(86) PCT No.: PCT/EP2013/053007
§ 371 (c)(1),
(2) Date: Aug. 6, 2014

(87) PCT Pub. No.: WO2013/120962
PCT Pub. Date: Aug. 22, 2013

(65) Prior Publication Data

US 2015/0049484 A1 Feb. 19, 2015

(30) Foreign Application Priority Data

Feb. 16, 2012 (DE) ..... 10 2012 202 354

(51) Int. Cl.

| | |
|---|---|
| ***F21V 23/00*** | (2015.01) |
| ***F21V 27/02*** | (2006.01) |
| ***F21K 99/00*** | (2010.01) |
| ***F21V 15/01*** | (2006.01) |
| ***F21V 23/06*** | (2006.01) |
| *F21Y 101/02* | (2006.01) |
| *F21Y 105/00* | (2006.01) |

(52) U.S. Cl.
CPC ..... *F21V 23/009* (2013.01); *F21K 9/30* (2013.01); *F21V 15/01* (2013.01); *F21V 23/006* (2013.01); *F21V 23/06* (2013.01); *F21V 27/02* (2013.01); *F21Y 2101/02* (2013.01); *F21Y 2105/001* (2013.01)

(58) Field of Classification Search
USPC ..... 362/249.02, 362, 375, 800
See application file for complete search history.

(56) References Cited

U.S. PATENT DOCUMENTS

| | | | | |
|---|---|---|---|---|
| 2,724,096 | A | 11/1955 | Klostermann | |
| 8,360,606 | B2 * | 1/2013 | Takei et al. | 362/249.01 |
| 8,496,349 | B2 * | 7/2013 | Wu et al. | 362/249.02 |

(Continued)

FOREIGN PATENT DOCUMENTS

| | | | |
|---|---|---|---|
| DE | 202007009655 | U1 | 10/2007 |
| DE | 102007037822 | A1 | 2/2009 |

(Continued)

OTHER PUBLICATIONS

English abstract of DE 102009054620 A1 of Jun. 16, 2011.

(Continued)

*Primary Examiner* — Laura Tso
(74) *Attorney, Agent, or Firm* — Viering, Jentschura & Partner mbB

(57) ABSTRACT

A lighting module may include a housing having an open rear side, a light source substrate with at least one light source arranged thereon, a driver circuit board accommodated in the housing, at least one electrical connection element for electrically connecting the driver circuit board to the light source substrate, and a closure element for closing the open rear side, wherein the closure element is designed for feeding through at least one electrical connection.

14 Claims, 7 Drawing Sheets

(56) References Cited

U.S. PATENT DOCUMENTS

| | | | | |
|---|---|---|---|---|
| 2008/0253127 | A1 | 10/2008 | Willwohl et al. | |
| 2011/0038172 | A1 | 2/2011 | Vollmer et al. | |
| 2011/0134634 | A1* | 6/2011 | Gingrich et al. | 362/231 |
| 2011/0205742 | A1 | 8/2011 | Lee | |
| 2011/0317412 | A1* | 12/2011 | Paik et al. | 362/235 |
| 2012/0025706 | A1* | 2/2012 | Wang et al. | 315/35 |
| 2012/0049732 | A1* | 3/2012 | Chuang | 315/32 |
| 2012/0069601 | A1 | 3/2012 | Tsai | |
| 2013/0020941 | A1 | 1/2013 | Breidenassel et al. | |
| 2013/0044500 | A1 | 2/2013 | Reingruber | |

FOREIGN PATENT DOCUMENTS

| | | | |
|---|---|---|---|
| DE | 202010008943 | U1 | 2/2011 |
| DE | 102009054620 | A1 | 6/2011 |
| DE | 102010030702 | A1 | 10/2011 |
| DE | 102010028481 | A1 | 11/2011 |
| EP | 1923626 | A1 | 5/2008 |
| FR | 2887034 | A1 | 12/2006 |

OTHER PUBLICATIONS

English abstract of EP 1923626 A1 of May 21, 2008.

International Search Report issued in the corresponding PCT application No. PCT/EP2013/053007, dated Apr. 11, 2013.

English abstract of FR 2887034 A1 of Dec. 15, 2006.

Office Action issued in the corresponding German application No. 102012202354.2, dated Oct. 9, 2012.

* cited by examiner

LIGHTING MODULE

RELATED APPLICATIONS

The present application is a national stage entry according to 35 U.S.C. §371 of PCT application No.: PCT/EP2013/053007 filed on Feb. 14, 2013, which claims priority from German application No.: 10 2012 202 354.2 filed on Feb. 16, 2012, and is incorporated herein by reference in its entirety.

TECHNICAL FIELD

Various embodiments relate to a lighting module, including a housing, a light source substrate with at least one light source arranged thereon, a driver circuit board accommodated in the housing, and at least one electrical connection element for electrically connecting the driver circuit board to the light source substrate.

BACKGROUND

Light-emitting diode (LED) modules have been produced in different constructions heretofore. This makes it considerably more difficult in practice to implement concepts involving identical parts for such LED modules. The geometrical form factors of the LED modules are predefined by circuit boards populated on one side. LED modules including a plurality of printed circuit boards are generally connected by cable connections.

SUMMARY

Various embodiments provide lighting modules having improved suitability for concepts involving identical parts.

Various embodiments provide a lighting module, including a housing having an open rear side, a light source substrate with at least one light source arranged thereon, a driver circuit board accommodated in the housing, at least one electrical connection element for electrically connecting the driver circuit board to the light source substrate, and a closure element for closing the open rear side, wherein the closure element is designed for feeding through at least one electrical connection.

Such a lighting module makes it possible to reduce thermal processes required for assembly. Moreover, a particularly compact design is made possible in this way. In addition, such a modular construction simplifies a use of concepts involving identical parts or an interchangeability of lighting modules. By virtue of the closure element, the driver circuit board can be accommodated simply and in the housing. The housing can be tightly sealed, such that the lighting module can in particular also fulfill various protection classes, e.g. protection classes of type I, II or III.

In one development, the driver circuit board has at least one electrical and/or electronic component or unit for operating the at least one light source, e.g. an integrated circuit, resistor, capacitor, etc. This enables a particularly high occupation density of light sources on the light source substrate and a protective accommodation of the driver required for operating the light sources. In one development thereof, the driver (or its electrical and electronic components) is (are) arranged exclusively on the driver circuit board.

Furthermore, in one development, the at least one light source includes at least one semiconductor light source. Preferably, the at least one semiconductor light source includes at least one light-emitting diode. In the event of a plurality of light-emitting diodes being present, they can emit light in the same color or in different colors. A color can be monochromatic (e.g. red, green, blue, etc.) or multichromatic (e.g. white). Moreover, the light emitted by the at least one light-emitting diode can be an infrared light (IR LED) or an ultraviolet light (UV LED). A plurality of light-emitting diodes can generate a mixed light; e.g. a white mixed light. The at least one light-emitting diode can contain at least one wavelength-converting phosphor (conversion LED). Alternatively or additionally, the phosphor can be arranged in a manner remote from the light-emitting diode ("remote phosphor"). The at least one light-emitting diode can be present in the form of at least one individually housed light-emitting diode or in the form of a least one LED chip. A plurality of LED chips can be mounted on a common substrate ("submount"). The at least one light-emitting diode can be equipped with at least one dedicated and/or common optical unit for beam guiding, e.g. at least one Fresnel lens, collimator, and so on. Instead of or in addition to inorganic light-emitting diodes, e.g. on the basis of InGaN or AlInGaP, organic LEDs (OLEDs, e.g. polymer OLEDs) can generally also be used. Alternatively, the at least one semiconductor light source may include e.g. at least one diode laser.

A lighting module can be understood to mean, in particular, a light-emitting unit or module which is not provided for independent lighting, but rather is typically provided for incorporation into a superordinate lighting unit, e.g. into a luminaire or a lighting system. In this regard, the lighting means typically does not have a dedicated power supply system connecting plug or the like. On the other hand, the lighting module is typically also not provided as a simple consumable article like a lamp or a lighting means.

In one configuration, the at least one electrical connection element includes at least two electrically conductive (contact) pins, e.g. composed of copper. The latter enable, in particular, a simple and more reliable contact-connection or at least preparation for a contact-connection already when the carrier circuit board is inserted or pushed into the housing.

However, only one pin or more than two pins may also be used.

In one development, the pins are (mechanically and electrically or "electromechanically") fixedly connected to the driver circuit board, which facilitates handling and the precise positioning thereof. The fixed connection to the driver circuit board can be produced by soldering, for example.

In one configuration that is preferred for providing a particularly stable connection with no thermal loading, the pins are fixed to the driver circuit board in a caulked manner, in particular in a cold-welded manner or in a cold-caulked manner (by means of "press-fit"). Alternatively or additionally, the pins can e.g. also be fixed to the light source substrate in a cold-caulked manner.

In a development that is preferred for a reliable contact-connection, simple handling and precise, in particular perpendicular, alignment, the pins are introduced into a respective, in particular narrow, feedthrough through the driver circuit board. The feedthrough can be implemented, in particular, by an electrically conductive sleeve or tube, which facilitates an electrical contact-connection, in particular in the case of a force-locking fit with the respective pin.

In a further configuration, the light source substrate is arranged outside the housing. In one configuration thereof, the light source substrate is arranged outside the housing. This enables a high luminous efficiency without any influencing by the housing. In addition, this enables an effective dissipation of heat from the light sources by heat convection.

In an alternative configuration thereof, the light source substrate is arranged within the housing. This enables the light source substrate and thus the light sources also to be accommodated in a leaktight manner. For the emission of light generated by the at least one light source, the housing can then have, for example, a light-transmissive cover, arranged in particular on the front side.

In a further configuration, the housing is electrically conductive. As a result, in particular, a protective conductor may be connected to the housing. In addition, a good thermal conductivity and thus heat dissipation are also provided in this way. The housing can consist in particular of metal, e.g. aluminum, which provides a particularly inexpensive, easily shapeable housing having very good electrical and thermal conductivity.

In yet another configuration, the housing has at least one feedthrough or cutout through which the pins are led.

For the purpose of simple contact-connection it is preferred for an end face of the contact pin that is led through the housing toward the outside to serve as an electrical contact area. The contact area can serve for example as a contact area for a bonding wire connected to the light source substrate at the other end.

The bonding wire can consist e.g. of gold, silver, copper and/or aluminum. In order to produce or improve its bondability, the contact area may be coated with a material layer suitable for this purpose, e.g. Ni/Au for bonding wires composed of aluminum or Ni/Pd/Au for bonding wires composed of gold.

In particular for the case where the light source substrate is arranged outside the housing, the pins can be surrounded by an electrical insulation at least in a portion led through the housing, in order to prevent an electrical connection to the housing.

Furthermore, in one configuration, the closure element for feeding through at least one electrical connection has at least one plated-through hole, and the driver circuit board has at least one spring contact (device) for making electrical contact with a plated-through hole of the closure element.

A simple electrical contact-connection that manages without further soldering methods, etc. is provided as a result. The spring contact may be an elastic, electrically conductive spring element, e.g. a leaf spring, which enables a simple configuration. The contact-connection of the termination plate by means of the spring contacts makes it possible to provide a simple, reliable and diverse electrical contact-connection that supports concepts involving identical parts.

The spring contact may be, in particular, a spring contact pin. A spring contact pin may have, in particular, two parts elastically displaceable relative to one another, in particular a sleeve with a pin mounted elastically displaceably therein.

In addition to the at least one spring contact, the driver circuit board may also have other electrical contacts, e.g. bonding pads and/or feedthroughs.

In one configuration, the at least one spring contact has been applied to the printed circuit board in a reflow soldering method. This affords the advantage that the spring contacts do not have to be applied in a separate method, if at least one further component (or element or unit) applied to the driver circuit board is likewise applied by means of a reflow soldering method. Such components are often used, e.g. surface-mounted components (SMD components).

In another configuration, provision is made of at least two spring contacts for connecting an operating voltage to an associated lighting module. The operating voltage may include, for example, a low voltage or a power supply system voltage. The operating voltage may be, in particular, between 10 and 250 volts.

In one development, the closure element has the same number of plated-through holes as the number of spring elements present on the driver circuit board. In this regard, a lighting module with a comparatively low material outlay is provided.

In another development, the closure element has a higher number of plated-through holes than the number of spring elements present on the driver circuit board. In this regard, a use of a standardized closure element with in each case different driver circuit boards is simplified.

In one development, moreover, the closure element has a smaller number of plated-through holes than the number of spring elements present on the driver circuit board. This enables a use of a plated-through hole for energizing a plurality of spring contacts and thus a simplified construction, in particular wiring of the driver circuit board.

In a further configuration, at least one plated-through hole of the closure element is configured in a rotationally symmetrical fashion. This enables contact to be made with the lighting module rotationally independently in a lighting device that accommodates the lighting module, e.g. a luminaire, a lighting system, etc. Moreover, the closure element may thus be screwed into the housing in a simple manner. For this purpose, the axis of symmetry of the rotationally symmetrical plated-through hole expediently coincides with the rotational axis of the closure element.

In yet another configuration, at least one plated-through hole is configured in a ring-shaped fashion.

Ring-shaped and/or rotationally symmetrical plated-through hole should in this sense also be understood to mean plated-through holes having respectively ring-shaped and/or rotationally symmetrical contact areas on one or both sides of the closure element, wherein the form of the connection between the contact areas can be fashioned arbitrarily. In other words, by way of example, a rotationally symmetrical contact track can be connected to a further rotationally symmetrical contact track on the opposite side by means of a pin-type intermediate element.

In particular, a plated-through hole may be present in the form of a connection point arranged concentrically with respect to the at least one ring-shaped plated-through hole. The connection point may be arranged, in particular, centrally in relation to the closure element. This simplifies a contact-connection that is more reliable in terms of avoiding incorrect contact, for example.

Furthermore, in one configuration, a contact area of the at least one spring contact and/or a contact area of the at least one plated-through hole have/has a surface layer having a high abrasion resistance. The surface layer can be in particular thick gold or an Ni/Au mixture, in particular alloy. A mechanically particularly robust and failsafe contact-connection is provided as a result.

In addition, in one configuration, the closure element is a printed circuit board, in particular of the FR or CEM type. This type of printed circuit board enables a particularly simple and inexpensive possibility of integration of plating processes.

In one development thereof, one base material of the printed circuit board includes CEM-1 to CEM-5, in particular CEM-3. Alternatively or additionally, one base material of the printed circuit board may include FR-2 to FR-5, in particular FR-4.

In one configuration, moreover, the closure element for feeding through at least one electrical connection has an, in particular central, cable channel. In particular, at least one electrical connection, in particular cable, may be applied to the driver circuit board and led or laid toward the outside through the cable channel.

Moreover, in one configuration, the closure element has at its side edge at least one fixing element which can be brought into engagement with at least one fixing mating element arranged on an inner wall of the housing.

Moreover, in one configuration, the closure element has at its side edge at least one fixing element in the form of recesses into which projections (which form the at least one fixing mating element) arranged on an inner wall of the housing engage. A latching fixing of the closure element on the housing is made possible as a result. The latching fixing may be realizable in particular without a tool and by simple pressing of the closure element into the housing. The projections may have a triangular shape or a sawtooth shape, for example, in cross section. The recess and the projection are embodied in particular in a manner extending circumferentially, the recess e.g. in the form of a ring groove.

The fixing element and the fixing mating element can very generally be parts of a latching connection. The fixing element and the fixing mating element can alternatively form a screw connection, e.g. with the fixing element as an outer thread and the fixing mating element as an inner thread, or vice versa. However, the closure element may alternatively or additionally also be adhesively bondable to the housing, press-fittable therein, etc.

In another configuration, the driver circuit board is potted in the housing. This affords the advantage that it can be fixed particularly firmly in the housing. Furthermore, an effective electrical insulation of the current-carrying regions situated on the driver circuit board with respect to the housing can thus be ensured (if the potting material is electrically insulating, e.g. consists of silicone). Furthermore, the potting compound intensifies a heat spreading.

Given the presence of contact pins for electrical connection between the driver circuit board and the light source substrate, they can likewise concomitantly be potted, which also reinforces their electrical insulation and mechanical fixing.

In one development, the housing is completely filled with the potting compound.

In particular, in an alternative configuration that is preferred for the case where spring contacts are present between the driver circuit board and the closure element, the housing is only partially filled with the potting compound and, in particular, leaves free a movable part of the at least one spring contact, that is to say forms a clearance therefor. This affords the advantage that an attachment, an adaptation and/or an exchange of the covering element is possible without any problems even with the potting having been introduced. In one development, the potting compound provides a clearance with regard to the closure element, that is to say that the latter is not potted.

For large-area distribution of the associated potting compound, the driver circuit board may have at least one channel preferably a plurality of channels, e.g. potting/ventilation holes. For the case where the potting is intended to be carried out with the closure element already having been attached, it is preferred for the closure element to have at least one channel, preferably a plurality of channels, e.g. potting/ventilation holes.

In yet another configuration, the housing has a thread on a lateral outer side.

Moreover, in one configuration, the housing has a hollow-cylindrical basic shape with a closed front side, and at least the driver circuit board and the closure element have a circular-disk-shaped basic shape and are aligned parallel to one another. The hollow-cylindrical basic shape simplifies a rotationally independent incorporation. In this regard, by way of example, provision of a thread on the lateral outer side or outer lateral surface of the housing for the incorporation of the lighting module is also facilitated.

In one development, the light source substrate also has a circular-disk-shaped basic shape and is aligned parallel to the driver circuit board and to the closure element.

In another configuration, the light source substrate is a ceramic substrate, in particular composed of an electrically insulating ceramic such as AlN. Ceramics have the advantage of a typically very good thermal conductivity of, for example, more than 50 W/(m·K), thus AlN of approximately 180 W/(m·K).

In an alternative development thereof, the substrate is a printed circuit board or circuit board, e.g. a metal-core circuit board.

In one development, moreover, the housing has at least one fixing device for (optionally) fixing at least one optical unit disposed downstream of the at least one light source. The at least one optical unit may include, for example, at least one light-transmissive (transparent or diffuse) cover, reflector, lens, collimator, etc. In one development thereof, the fixing device has a groove arranged on an outer side of the housing and extending circumferentially at least in sectors (in particular completely). The groove may be arranged, in particular, in a manner laterally surrounding the at least one light source substrate, in order to enable the at least one light source to be covered in a structurally simple manner.

In an alternative or additional development, provision is made of at least one optical unit (e.g. a light-transmissive cover) for one or a plurality of lighting modules jointly by means of a superordinate lighting device (luminaire, etc.) in which the lighting module is incorporated.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
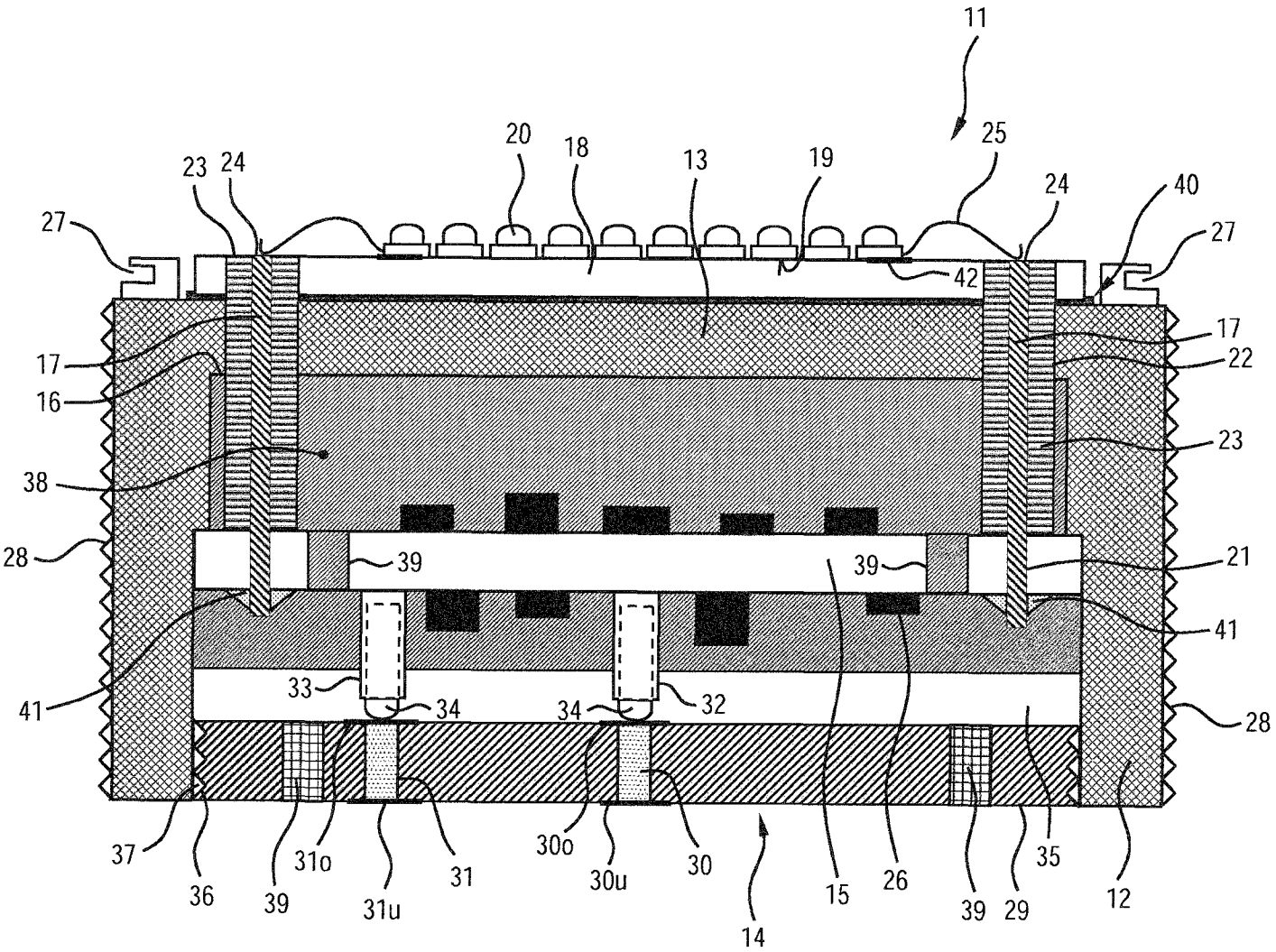
FIG. 1 shows as a sectional illustration in side view a lighting module in accordance with a first embodiment.

FIG. 1 shows a lighting module 11 for incorporation in a luminaire, a luminaire system, etc.

The lighting module 11 includes a metallic housing 12 having a hollow-cylinder-like basic shape, having a basically closed front side 13 and an open rear side 14. A circular-disk-shaped driver circuit board 15 including CEM-3 or FR-4 as the base material thereof is accommodated in the housing 12. For simple and correct positioning of the driver circuit board 15, the latter bears by an outer edge of its front side on an internal projection 16 or taper of the housing 12.

Figure 2:
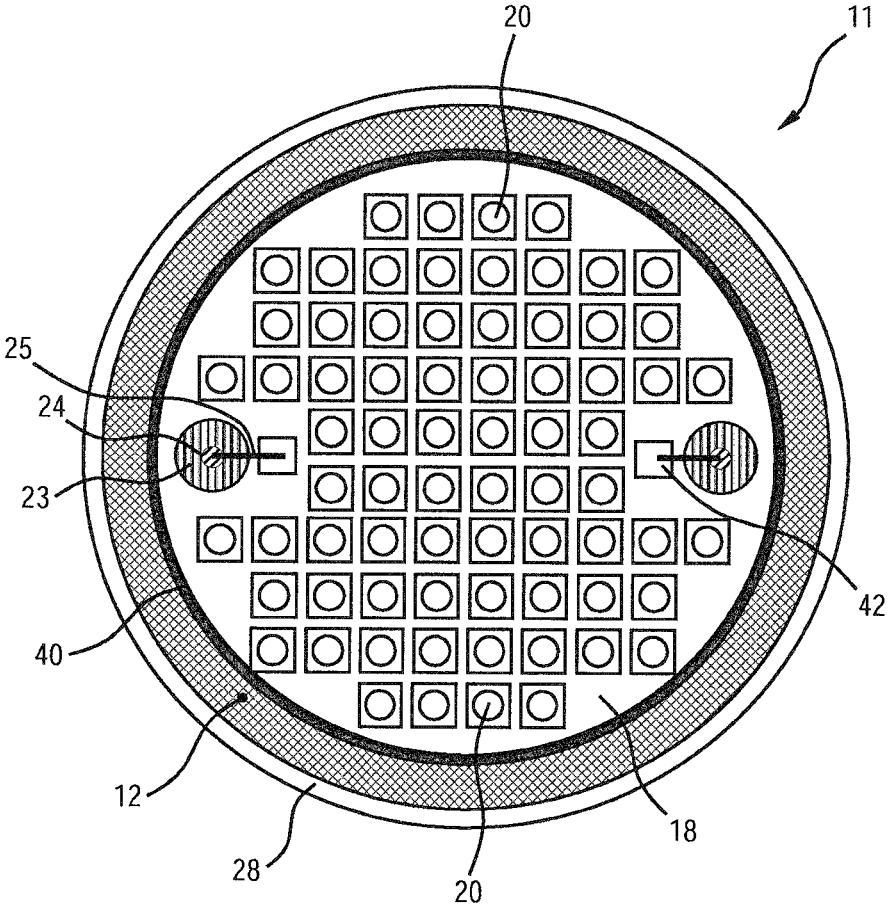
FIG. 2 shows the lighting module in accordance with the first embodiment in a view from above.

The driver circuit board 15 is electrically connected to a light source substrate 18 by means of two vertical, electrically conductive contact pins 17. The light source substrate 18 is arranged outside the housing 12; to be precise, it bears by its rear side in a planar manner on the front side 13 of the housing 12, here by means of a thermally conductive adhesive 40. A free front side 19 of the light source substrate 18 is equipped with a plurality of light sources in the form of light-emitting diodes 20, which e.g. emit white light, as also shown in FIG. 2. The light source substrate 18 consists of aluminum nitride (AlN), such that the light-emitting diodes 20 are electrically insulated from the housing 12, but are connected to the housing 12 via only a low thermal resistance, the housing then acting as a heat sink.

The contact pins 17 lead, on the one hand, through respective narrow feedthroughs 21 through the driver circuit board 15 and are electrically and mechanically interconnected with the latter on the rear side at a soldering location 41. On the other hand, the contact pins 17 project through corresponding feedthroughs 22 of the housing 12 and of the light source substrate 18. In order to prevent an electrical connection between the housing 12 and the respective contact pin 17, the portion of the contact pins 17 that is on the front side relative to the driver circuit board 15 is laterally surrounded by an electrically insulating enclosure 23, e.g. composed of plastic. An end face 24 of the contact pin 17 that is led toward the outside through the housing 12 serves as an electrical contact area for a respective bonding wire 25. The respective bonding wire 25 is in turn connected to the light source substrate 18, e.g. by means of a so-called bonding pad 42 thereof. The bonding pad or the bonding pads 42 is/are connected to the light-emitting diodes 20 by means of wirings (not shown). Instead of a bonding pad 42, e.g. a soldering contact area or "solder pad" can also be used. The end face 24 of the contact pin 17 may include a particularly readily bondable or solderable layer (not illustrated).

The driver circuit board 15 has a plurality of electrical and/or electronic components 26 which form a driver for operating the light-emitting diodes 20. The driver circuit board 15 therefore serves as a driver circuit board. An operating signal generated by means of the components 26 is applied to the light-emitting diodes 20 via the contact pins 17. The components 26 are at least in part SMD components, which facilitates their simple application, in particular by means of a reflow soldering method.

A fixing device for fixing at least one optical unit (not illustrated) disposed downstream of the light-emitting diodes 20 jointly is furthermore situated at the front side 13 of the housing 12. The fixing device is embodied in the form of a radially laterally aligned groove 27 which extends circumferentially around the light source substrate 18 or the light-emitting diodes 20 and which can have e.g. perforations for fixing by means of a plugging/turning connection or bayonet connection.

An outer thread 28 for the incorporation of the lighting module 11 is situated on the external or outer lateral surface of the housing 12.

Figure 3:
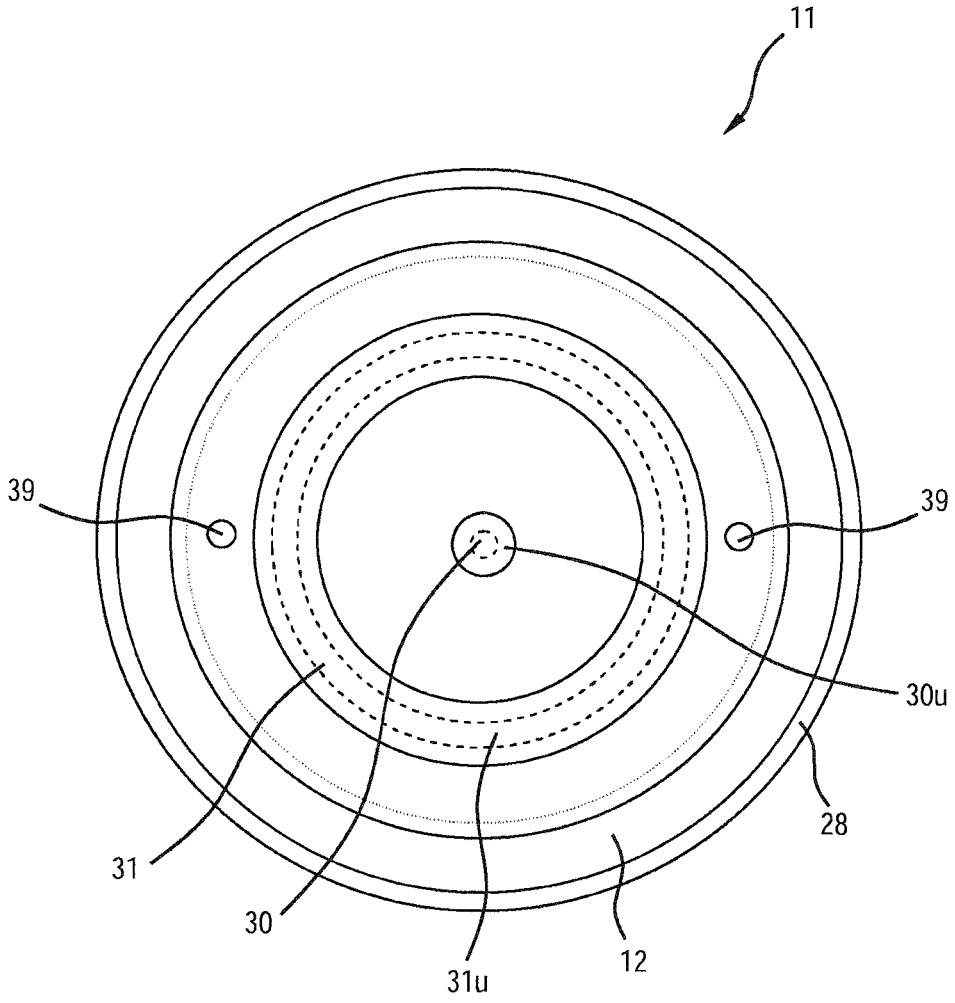
FIG. 3 shows the lighting module in accordance with the first embodiment in a view from below.

The open rear side 14 of the housing 12 is closed with a circular-disk-shaped closure element in the form of a further printed circuit board, the closure printed circuit board 29, as shown in plan view in FIG. 3. The closure printed circuit board has an inner, punctiform plated-through hole 30 and an outer, ring-shaped plated-through hole 31 arranged concentrically with respect thereto. This form of the plated-through holes 30, 31 enables a rotationally independent contact-connection that is comparatively reliable in terms of avoiding incorrect contact. On the underside and thus on the outer side, the plated-through holes 30, 31 can be contact-connected in any desired manner, e.g. by soldering. The closure printed circuit board 29 seals the housing 12 and the driver circuit board 15 accommodated therein, e.g. in order to achieve a desired protection class.

The plated-through holes 30, 31 have contact areas 30*o* and 30*u* and, respectively, 31*o* and 31*u*, widened at the top side (directed into the housing 12) and at the underside (outer side), which facilitates their contact-connection, soldering, etc.

The plated-through holes 30, 31 or the contact areas 300, 310 thereof on the top side are connected to the driver circuit board 15 via two spring contact pins 32, 33. Consequently, the driver formed by means of the components 26 can be supplied or fed, e.g. with a power supply system voltage, via the plated-through holes 30, 31 and furthermore the spring contact pins 32, 33. The spring contact pins 32, 33 have been fitted to the underside of the driver circuit board 15 by reflow soldering and produce a pressure contact at the plated-through holes 30 and 31, respectively. An abrasion-resistant surface layer in the form e.g. of an Ni/Au alloy is situated on the contact areas 30*o*, 30*u*, 31*o*, 31*u* of the plated-through holes 30, 31.

For fixing to the housing 12, the closure printed circuit board 29 has at its side edge sawtooth-shaped recesses 36 into which conformal projections 37 arranged on an inner wall of the housing 12 engage in a latching manner.

In particular also for electrical insulation from the housing 12, the driver circuit board 15 is potted in the housing 12, e.g. with silicone as potting compound 38. The contact pins 17 and their enclosures 23 are concomitantly potted.

However, the spring contact pins 32, 33 or their displaceably mounted pins 34 are not potted, with the result that they remain mobile. This is achieved by means of a corresponding clearance 35.

For large-area distribution of the associated potting compound 38, both the driver circuit board 15 and the closure printed circuit board 29 have a plurality of continuous channels in the form of potting/ventilation holes 39, wherein the potting/ventilation holes 39 of the closure printed circuit board 29 are tightly closed.

Figure 4:
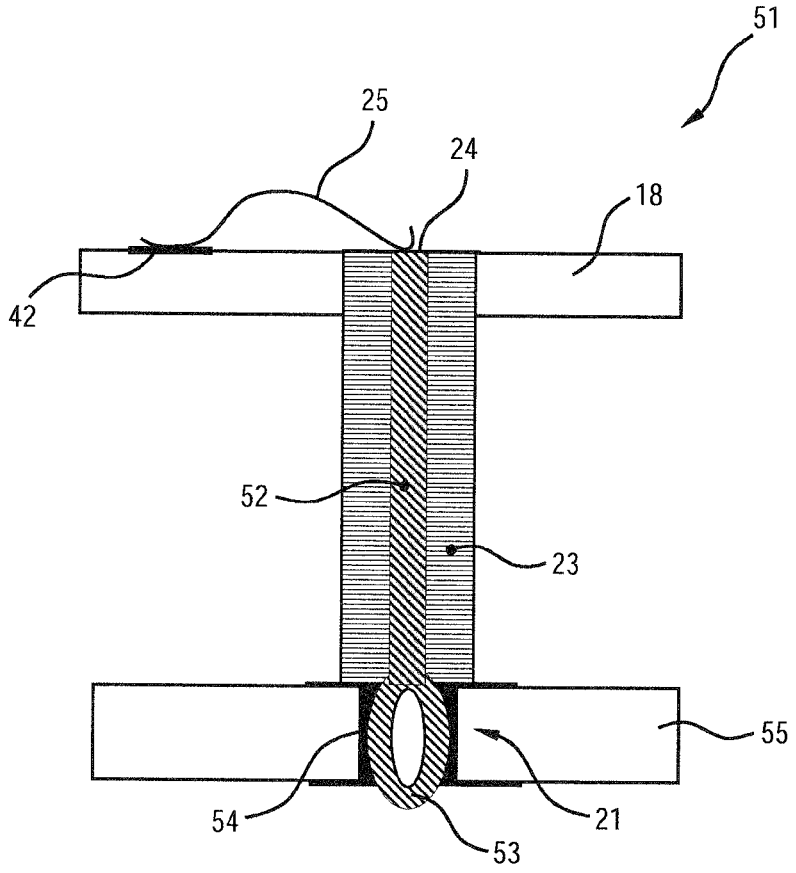
FIG. 4 shows as a sectional illustration in side view an excerpt from a lighting module in accordance with a second embodiment.

FIG. 4 shows as a sectional illustration in side view an excerpt from a lighting module 51. The lighting module 51 is constructed similarly to the lighting module 11, except that now the contact pins 52, one of which is shown here by way of example, for connecting the driver circuit board 55 to the light source substrate 18 are configured as cold-weldable or cold-caulkable ("press-fit") contact pins 17.

The contact pin 52 has, at its (lower) end fixed to the driver circuit board 55, a cold-deformable end region 53, which is inserted into the narrow feedthrough 21 and may protrude slightly downward. For electrical contact-connection and mechanically stable mounting, a metallic or metalized sleeve 54 is inserted into the feedthrough of the driver circuit board 55.

The end region 53 is firstly inserted into the sleeve 54 and then widened by cold caulking in such a way that it is fixed in a force-locking manner or in a frictionally locking manner in a press fit in the sleeve 54. The sleeve 54 serves as electrical contact of the driver circuit board 55, such that soldering or some other connection method with thermal loading can be dispensed with.

The insulating enclosure 23 is present only on a portion of the contact pin 52 above the end region 53.

Figure 5:
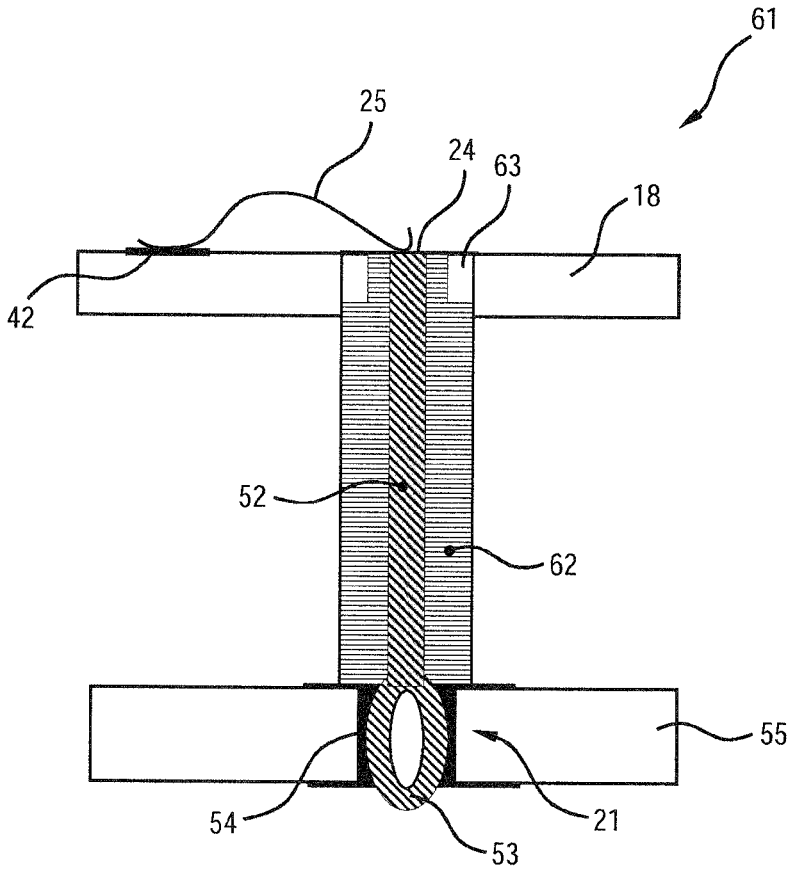
FIG. 5 shows as a sectional illustration in side view an excerpt from a lighting module in accordance with a third embodiment.

FIG. 5 shows as a sectional illustration in side view an excerpt from a lighting module 61 in accordance with a third embodiment. The lighting module 51 is constructed similarly to the lighting module 11, except that now the electrically insulating enclosure 62 has, at its (upper) end region introduced into the light source substrate 18, a circumferentially extending taper, here in the form of a circumferentially extending step 63, in order to lengthen a creepage path and to provide a stop location for a mechanism.

Figure 6:
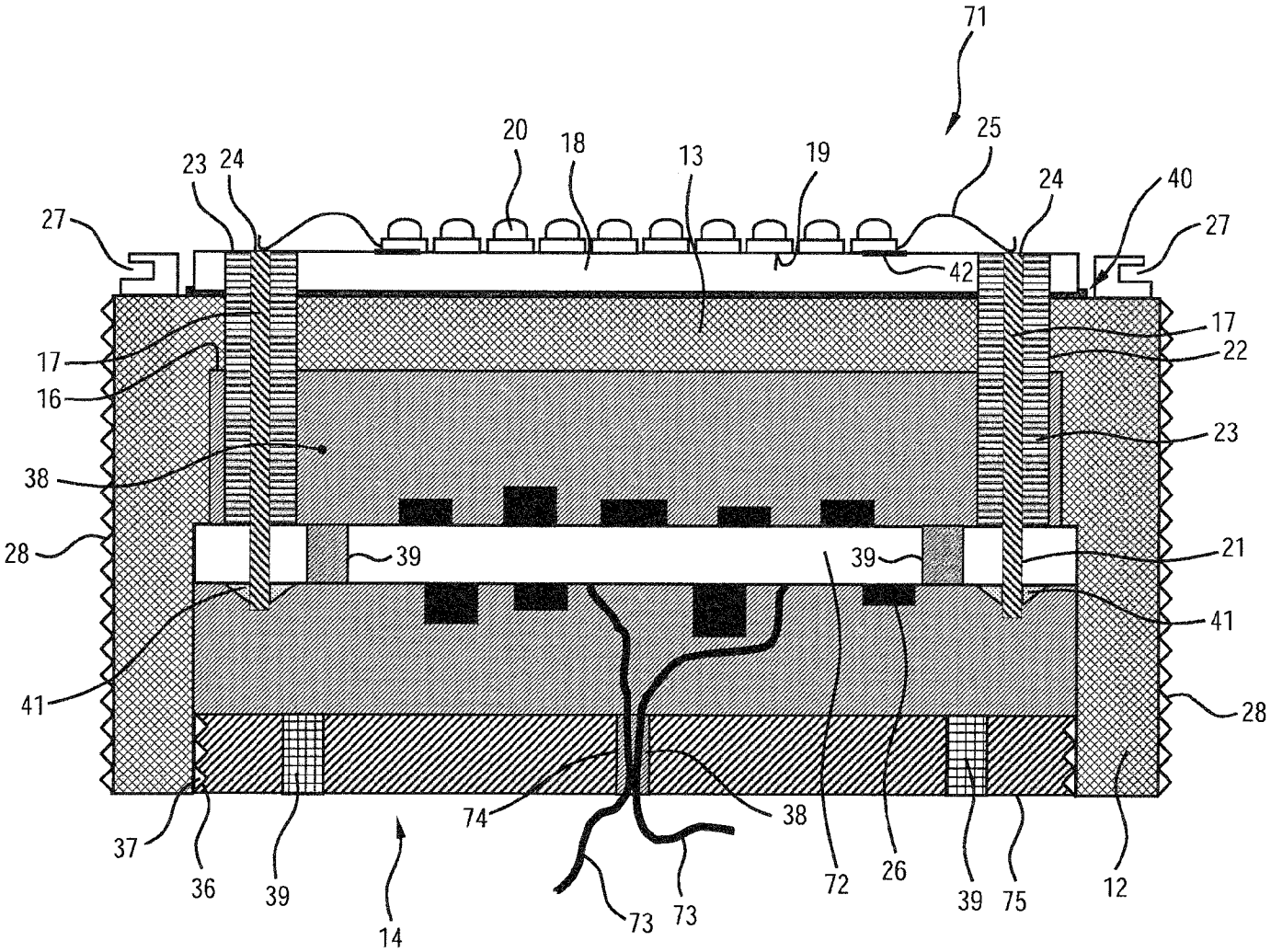
FIG. 6 shows as a sectional illustration in side view a lighting module in accordance with a fourth embodiment.
Figure 7:
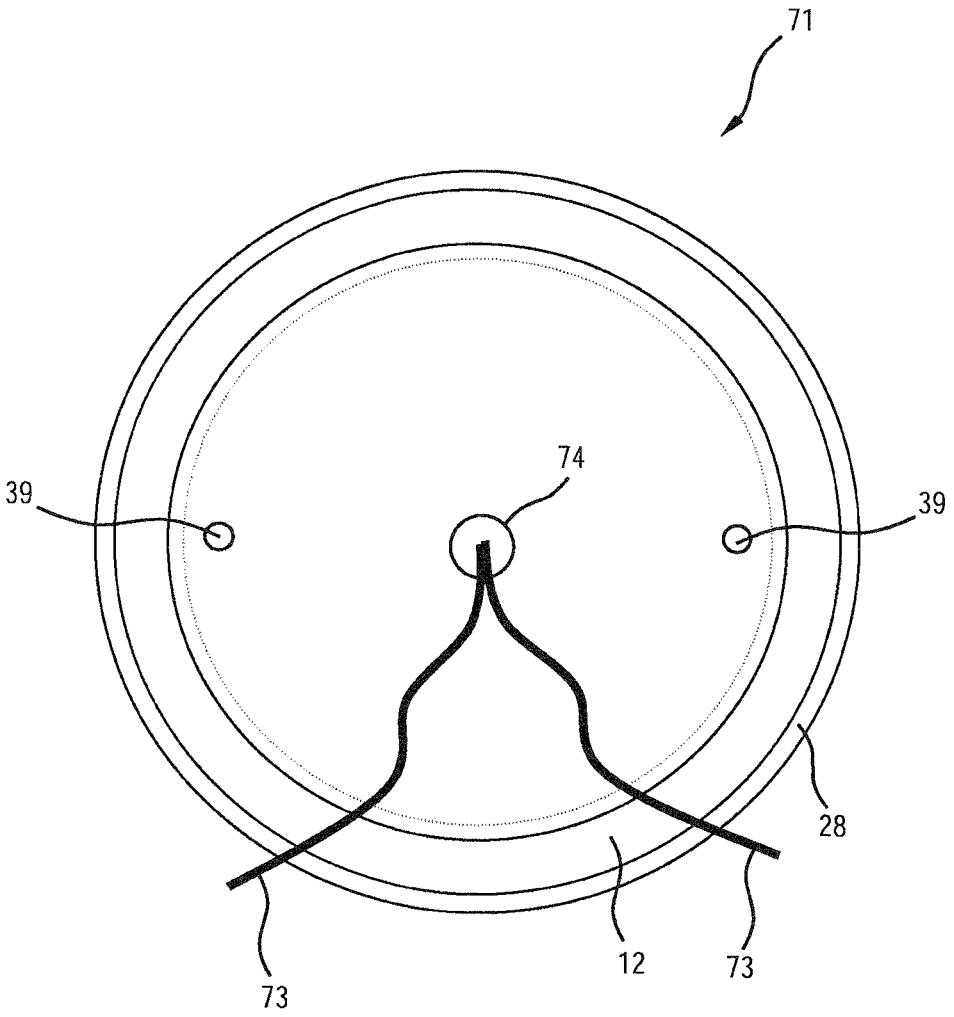
FIG. 7 shows the lighting module in accordance with the fourth embodiment in a view from below.

FIG. 6 shows a lighting module 71 as a sectional illustration in side view. FIG. 7 shows the lighting module 71 in accordance with the fourth embodiment in a view from below.

The lighting module 71 is constructed similarly to the lighting module 11, but now the driver circuit board 72 is not connected to the closure printed circuit board 75 via spring contact pins. Rather, two triply insulated cables 73 are fitted to the driver circuit board 72, said cables being led toward the outside through a central cable channel 74 of the closure printed circuit board 75.

The housing 12 is now additionally completely filled with the potting compound 38, which also seals the central cable channel 74.

It goes without saying that the present disclosure is not restricted to the embodiment shown.

In this regard, the cold-caulkable contact pins may additionally or alternatively be cold-caulkable or cold-caulked to the light source substrate 18.

Moreover, by way of example, an end section at the top side of the contact pin, which runs in the light source substrate, may have no insulating enclosure.

In addition, a plurality of driver circuit boards may be accommodated in the housing, which are spaced apart from one another, in particular, and are aligned parallel to one another, in particular. The driver circuit boards can be electrically interconnected preferably by means of contact pins.

Generally, the occupation of the printed circuit board(s)/substrate(s) is not restricted to light sources or driver components.

Generally, the printed circuit board(s)/substrate(s) can be designated as functional substrates, e.g. the light source substrate as one possible embodiment of a first functional substrate and the driver circuit board as one possible embodiment of a second functional substrate.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SIGNS

11 Lighting module
12 Housing
13 Closed front side of the housing
14 Open rear side of the housing
15 Driver circuit board
16 Internal projection
17 Contact pin
18 Light source substrate
19 Free front side of the light source substrate
20 Light-emitting diode
21 Feedthrough of the driver circuit board
22 Feedthrough of the housing
23 Insulating enclosure
24 End face of the contact pin
25 Bonding wire
26 Component
27 Groove
28 Outer thread
29 Closure printed circuit board
30 Inner, punctiform plated-through hole
**30*o*** Contact area widened at the top side
**30*u*** Contact area widened at the underside
31 Outer, ring-shaped plated-through hole
**31*o*** Contact area widened at the top side
**31*u*** Contact area widened at the underside
32 Spring contact pin
33 Spring contact pin
34 Displaceably mounted pin
35 Clearance
36 Recess
37 Projection
38 Potting compound
39 Potting/ventilation hole
40 Thermally conductive adhesive
41 Soldering location
42 Bonding pad
51 Lighting module
52 Contact pin
53 End region
54 Sleeve
55 Driver circuit board
61 Lighting module
62 Insulating enclosure
63 Step
71 Lighting module
72 Driver circuit board
73 Cable
74 Cable channel
75 Closure printed circuit board

The invention claimed is:

1. A lighting module, comprising:

a housing having an open rear side, a light source substrate with at least one light source arranged thereon, a driver circuit board accommodated in the housing, at least one electrical connection element for electrically connecting the driver circuit board to the light source substrate, and a closure element for closing the open rear side, wherein the closure element is designed for feeding through at least one electrical connection, wherein the at least one electrical connection element comprises at least two electrically conductive pins, wherein the light source substrate is arranged outside the housing, the housing is electrically conductive, the housing has at least one cutout through which the electrical connection elements are led, and the electrical connection elements are surrounded by an electrical insulation at least in a portion led through the housing.

2. The lighting module as claimed in claim 1, wherein the pins are fixed to the driver circuit board in a caulked manner.

3. The lighting module as claimed in claim 1, wherein the closure element has at its side edge at least one fixing element which can be brought into engagement with at least one fixing mating element arranged on an inner wall of the housing.

4. The lighting module as claimed in claim 1, wherein the driver circuit board is potted in the housing.

5. The lighting module as claimed in claim 1, wherein the light source substrate is a ceramic substrate.

6. The lighting module as claimed in claim 1, wherein the pins are fixed to the driver circuit board in cold-caulked manner.

7. A lighting module, comprising:

a housing having an open rear side, a light source substrate with at least one light source arranged thereon, a driver circuit board accommodated in the housing, at least one electrical connection element for electrically connecting the driver circuit board to the light source substrate, and a closure element for closing the open rear side, wherein the closure element is designed for feeding through at least one electrical connection, wherein the closure element for feeding through at least one electrical connection has at least one plated-through hole, and the driver circuit board has at least one spring contact for making electrical contact with a plated-through hole of the closure element.

8. The lighting module as claimed in claim 7, wherein the at least one plated-through hole of the closure element is configured in a rotationally symmetrical fashion.

9. The lighting module as claimed in claim 8, wherein the at least one plated-through hole is configured in a ring-shaped fashion.

10. The lighting module as claimed in claim 7, wherein the closure element for feeding through at least one electrical connection has a cable channel.

11. The lighting module as claimed in claim 7, wherein the at least one spring contact is spring contact pin.

12. The lighting module as claimed in claim 7, wherein the closure element for feeding through at least one electrical connection has a central cable channel.

13. A lighting module, comprising:

a housing having an open rear side, a light source substrate with at least one light source arranged thereon, a driver circuit board accommodated in the housing, at least one electrical connection element for electrically connecting the driver circuit board to the light source substrate, and a closure element for closing the open rear side, wherein the closure element is designed for feeding through at least one electrical connection, wherein the housing has a thread on a lateral outer side.

14. A lighting module, comprising:

a housing having an open rear side, a light source substrate with at least one light source arranged thereon, a driver circuit board accommodated in the housing, at least one electrical connection element for electrically connecting the driver circuit board to the light source substrate, and a closure element for closing the open rear side, wherein the closure element is designed for feeding through at least one electrical connection, wherein the housing has a hollow-cylindrical basic shape with a closed front side, and at least the driver circuit board and the closure element have a circular-disk-shaped basic shape and are aligned parallel to one another.

* * * * *